US005423573A

United States Patent [19]

de Passillé

[11] Patent Number: 5,423,573

[45] Date of Patent: Jun. 13, 1995

[54] COMPOSITE STAMP

[75] Inventor: Georges de Passillé, Hull, Canada

[73] Assignee: Canada Post Corporation, Ottawa, Canada

[21] Appl. No.: 188,059

[22] Filed: Jan. 26, 1994

[51] Int. Cl.[6] ..... G09F 3/00

[52] U.S. Cl. ..... 283/71; 283/81; 40/638

[58] Field of Search ..... 283/71, 81, 117, 100, 283/101; 40/630, 638

[56] References Cited

U.S. PATENT DOCUMENTS

| | | | |
|---|---|---|---|
| 1,590,158 | 6/1926 | Fletcher | 283/71 |
| 4,725,077 | 2/1988 | Fujita | 283/81 X |
| 4,872,706 | 10/1989 | Brewen et al. | 283/81 |
| 5,044,669 | 9/1991 | Berry | 283/81 |
| 5,064,222 | 11/1991 | Legault | 283/71 |
| 5,098,130 | 3/1992 | Mikhail | 283/71 |
| 5,267,754 | 12/1993 | Kaule | 283/71 |

FOREIGN PATENT DOCUMENTS

| | | |
|---|---|---|
| 369063 | 9/1937 | Canada . |
| 1414777 | 11/1975 | United Kingdom . |

*Primary Examiner*—Hwei Siu Payer
*Attorney, Agent, or Firm*—Woodard, Emhardt, Naughton, Moriarty & McNett

[57] ABSTRACT

A composite stamp has two parts that are used in combination to provide the finished stamp on a piece of mail. One part bears a decorative design, and the second part bears the normal identifying postage-related information including country, denomination, etc. and also has an area on which the first part is to be adhered. Both parts have adhesive backs and may, for example, be provided in dry-peelable form on a suitable carrier substrate.

13 Claims, 3 Drawing Sheets

COMPOSITE STAMP

BACKGROUND OF THE INVENTION (a) Field of the Invention

This invention relates to improvements in postage stamps and similar articles and in particular relates to a new or improved postage stamp of composite form.

(b) Description of the Prior Art

Traditionally, postage stamps have been provided in the form of perforated sheets, one side of such a sheet being printed with multiple rows of impressions of the postage stamp, usually in rectangular form, individual stamps being separated by lines of perforation, and the rear side of the sheet being coated with a water-activated adhesive. In response to the demands philatelists and others for a more varied product, and also in an effort to improve marketability of the product, the postal authorities in various countries have in recent years introduced a variety of modifications which depart from the concept of the traditional postage stamp referred to above.

In a somewhat different vein, U.S. Pat. No. 4,872,706 Brewen et al. discloses a postage advertising label bearing on one side thereof an advertising message, and having adhered to one corner thereof a regular postage stamp.

SUMMARY OF THE INVENTION

It is an object of the present invention to provide an composite postage stamp which, in addition to the stamp design as provided by the postal authority for postage purposes, also provides a means whereby the user may customize the stamp by adding thereto a further image or message.

More particularly, the invention provides a composite postage stamp comprising: a larger definitive part and a complementary smaller image-bearing part, each said part having a printed front surface and an adhesive rear surface coating; said definitive part being adapted in use to be adhered to a piece of mail, and said image-bearing part being adapted in use to be adhered to a selected area of the front surface of said definitive part. Each of said two parts preferably has a self-adhesive rear surface coating by means of which the part is temporarily and releasably adhered to a carrier substrate to be selectively peelable therefrom at the time of use.

The definitive part of the stamp alone bears all necessary machine readable indicia such as a barcode phosphor lines or other expedients designed to interact with automatic sorting machines in recognizing and verifying postage.

The definitive part can be of any desired shape, and may be rectangular and provided in panes of the traditional kind.

Preferably the printed front surface of the definitive part delimits an area that is sized to receive the image-bearing part, and a selection of alternate image-bearing parts are provided so that the user can customize the completed stamp by utilizing an appropriate image, e.g. in celebration of a birthday or anniversary, and so forth. Conveniently the definitive part is provided on a common substrate with the selection of image-bearing parts. For example the parts may be provided on interconnected panels of a stiff cardboard substrate, the panels folding together to form a wallet with the stamp parts on the internal surfaces thereof. Only the definitive part is a legal postage stamp and it may be used for postal purposes either alone, or in combination with the image-bearing part.

Alternatively, the common substrate may be in the form of a flexible film that is provided in rolled condition. Still further, the definitive and image-bearing parts may be provided on separate substrates such as rolls, for example where a user has a requirement for a large number of identical image-bearing parts.

It will be appreciated that the concept outlined above lends itself to a large number of applications. For example for large volume mailers it would be possible to utilize one or a series of image-bearing parts identifying or advertising a company and/or its products.

BRIEF DESCRIPTION OF THE DRAWINGS

The invention will further be described, by way of example only, with reference to the accompanying drawings wherein.

DESCRIPTION OF THE PREFERRED EMBODIMENT

Figure 1:
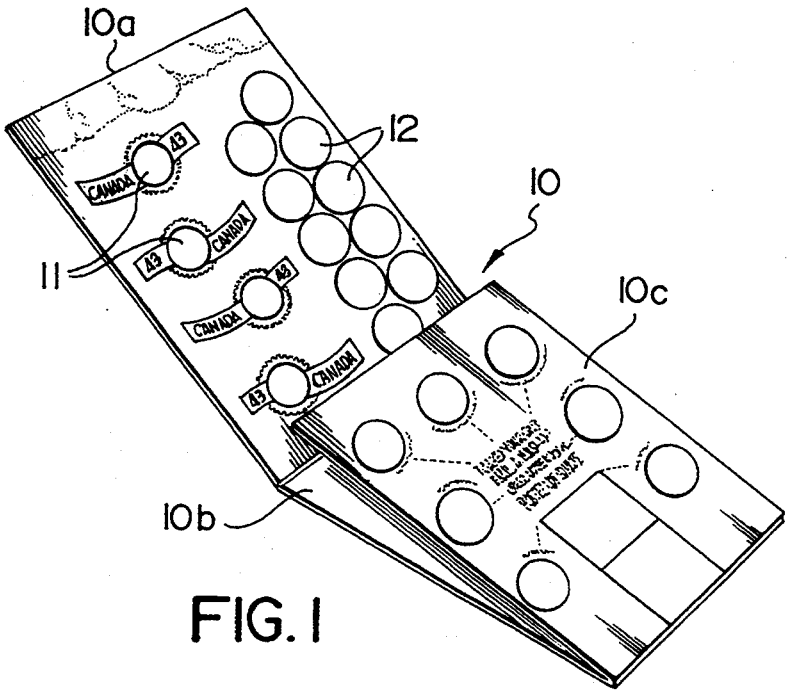
FIG. 1 is a somewhat schematic perspective view illustrating one preferred embodiment of the present invention.
Figure 2:
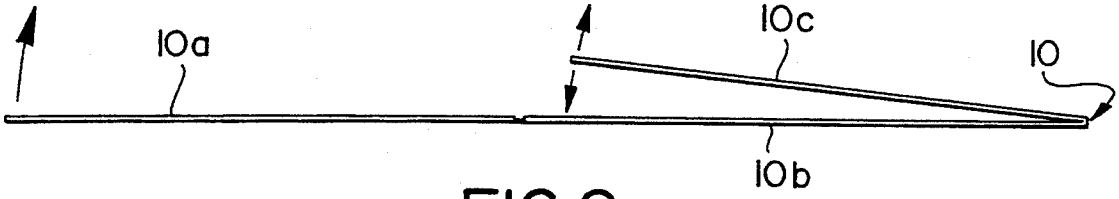
FIG. 2 is a corresponding side view.
Figure 3:
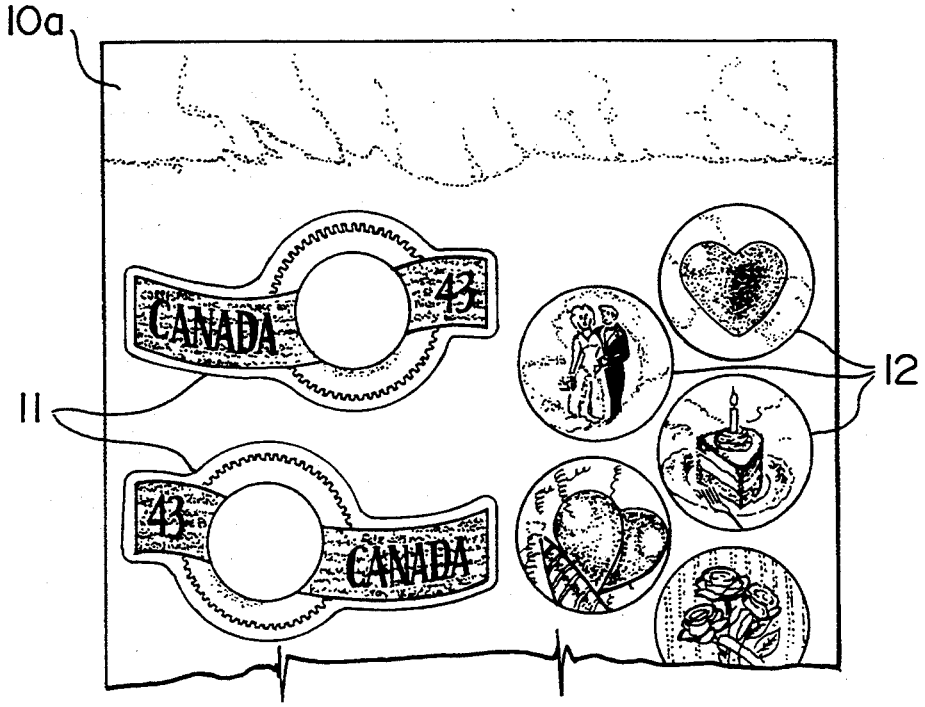
FIG. 3 is an enlarged plan view of a portion of the article shown in FIGS. 1 and 2.

FIG. 1 illustrates a wallet (10) having three rectangular panels **(10*a*, 10*b*, 10*c*) that are pivotably interconnected by means of creases as shown and which can be folded into overlapping relation as indicated by the arrows in FIG. 2 to form a flat rectangular package. Each of the panels bears on one of its surfaces, i.e. the surface that will be on the interior when the wallet is folded as shown in FIG. 2, an array of postage stamp parts, which for convenience of identification will herein be referred to as a definitive part (11) and an image-bearing part (12) respectively. The stamp parts (11) and (12)** are discrete portions each having an upper side which bears graphic information, and an underside which contains a coating of pressure-sensitive adhesive material by means of which the stamp part is temporarily and releasably attached to the surface of the wallet part so that it can be readily peeled therefrom when required for use. To enhance the peelability of the stamp part, the surface of the wallet may be formed from or coated with a substance that will inhibit any permanent bonding of the stamp part thereto, e.g. substances such as silicone.

Figure 4:
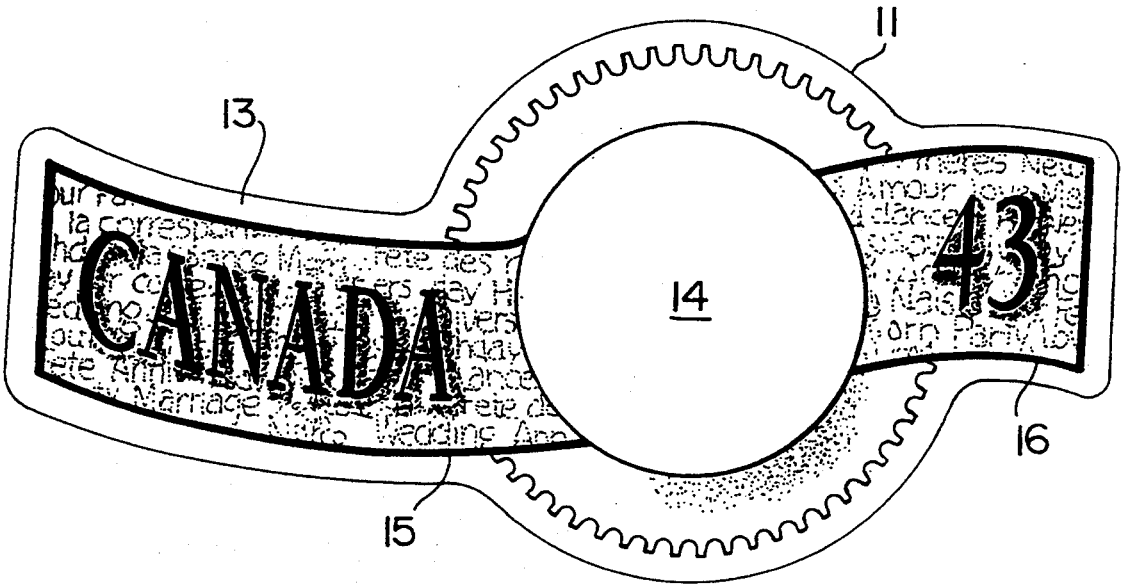
FIG. 4 is an enlarged plan view showing the definitive part of a postage stamp.

The stamp parts (11) and (12) may be of any desired configuration, and as shown in FIG. 4 part (11) may have a white margin (13) which surrounds the printed area.

As best shown in FIG. 4, the definitive part (11) delimits a blank area (14) that is of a size that corresponds to the image-bearing parts (12). Outside the blank area, the definitive part (11) bears information regarding the country (15) and the denomination (16) to which the stamp pertains. Additionally the part (11) bears machine-readable indicia such as bar code, phosphor lines, or other expedients designed to aid automatic mail-sorting machines in recognizing and verifying the postage applied to various pieces of mail.

The pressure-sensitive adhesive used on the back of the stamp parts is of such a nature that it maintains flexibility and adhesiveness more or less indefinitely and through a large range of temperatures e.g. from −20° C. to +30° C. The adhesive should be such that although it adheres only to a limited extent to the substrate panels (10*a*), (10*b*), (10*c*) and can be readily peeled therefrom, it will adhere strongly and permanently to untreated paper surfaces of the type used in mail envelopes and packages. Suitable pressure sensitive adhesives are commercially available from suppliers such as Kleen Stick-Fasson Inc., of Ajax, Ontario, Canada. "Peel and Stick" self-adhesive postage stamp material may be utilized, such material being available from Jack Straedt, Germany and Jac Australia Pty Ltd., Australia.

Figure 5:
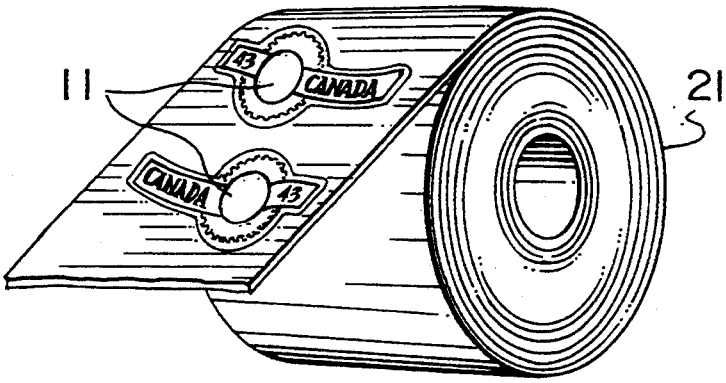
FIGS. 5 and 6 are perspective views illustrating alternative embodiments.
Figure 6:
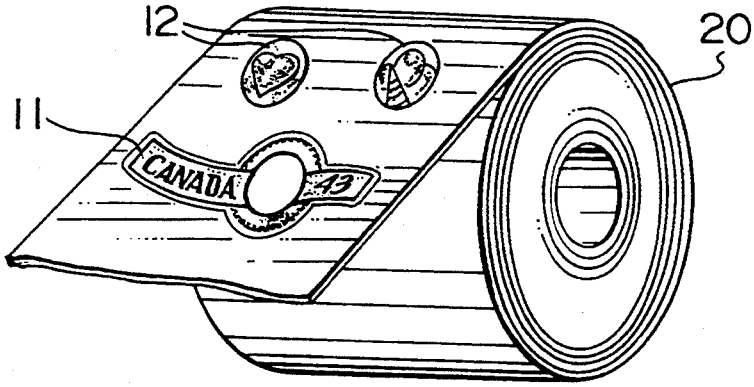

Alternative forms of the invention are shown in FIGS. 5 and 6, FIG. 6 showing the stamp parts (11) and (12) provided on a common continuous roll (20) of a suitable substrate. Alternatively, the definitive stamp parts (11) can be provided as in FIG. 5 on one roll (21), and the image-bearing parts provided on a separate roll (not shown). For example where instead of a selection of image-bearing parts, a particular user may want a large number of identical image-bearing parts, these may be provided in a separate roll.

Although particular preferred embodiments have been set forth in the foregoing description and in the accompanying drawings, it will be understood that many modifications can be made and will occur to a person of ordinary skill in the art. For example the shape of the definitive and image-bearing parts of the stamp can be varied almost without limitation, as to size, configuration, and appearance. All such modifications are intended to be included within the scope of the appended claims.

What is claim is:

1. A composite postage stamp comprising:

at least one larger definitive part;

at least one smaller image-bearing part which in use is adhered to said larger definitive part;

said at least one larger definitive part being constructed and arranged with a printed front surface having a defined predetermined area and a self-adhesive rear surface coating and initially being temporarily and releasably adhered to a carrier substrate and selectively peelable therefrom for use in said composite postage stamp, said printed front surface of said at least one larger definitive part including postage-identifying information; and said at least one smaller image-bearing part being constructed and arranged with a printed front surface and a self-adhesive rear surface coating and initially being temporarily and releasably adhered to a carrier substrate and selectively peelable therefrom for use in said composite postage stamp by adhering said at least one smaller image-bearing part to said predetermined area.

2. A supply of composite postage stamps as claimed in claim 1 wherein there are at least two series of image-bearing parts and wherein said carrier substrate is common to all of said parts, said common carrier substrate being formed of relatively stiff cardboard having on and surface thereof a release coating from which a selected one of said parts can readily be peeled.

3. A supply of composite postage stamps as claimed in claim 2 wherein said common carrier substrate comprises a plurality of interconnected panels that can be folded together in the form of a wallet, the surfaces upon which said parts are adhered being covered when the wallet is in a folded condition.

4. A supply of composite postage stamps as claimed in claim 1 wherein the carrier substrate associated with said at least one larger definitive part is the same carrier substrate which is associated with said at least one smaller image-bearing part, said same carrier substrate being flexible in nature and provided in a rolled form.

5. A supply of composite postage stamps as claimed in claim 14 wherein the carrier substrate associated with said at least one larger definitive part is separate from the carrier substrate associated with said at least one smaller image-bearing part, each of said carrier substrates being flexible in nature and provided in a rolled form.

6. A composite postage stamp comprising:

a larger definitive part;

at least one smaller image-bearing part which in use is adhered to said larger definitive part;

said larger definitive part constructed and arranged with a printed front surface and a self-adhesive rear surface coating and initially being temporarily and releasably adhered to a common carrier substrate and selectively peelable therefrom for use in said composite postage stamp, said printed front surface of said larger definitive part including postage-identifying information; and said at least one smaller image-bearing part being constructed and arranged with a printed front surface and a self-adhesive rear surface coating and initially being temporarily and releasably adhered to said common carrier substrate and selectively peelable therefrom for use in said composite postage stamp.

7. A composite postage stamp as claimed in claim 6 wherein the printed front surface of said definitive part delimits an area sized to receive said at least one image-bearing part.

8. A composite postage stamp as claimed in claim 6 wherein said common carrier substrate is of relatively stiff cardboard having on one surface thereof a release coating from which said parts of the stamp can readily be peeled.

9. A composite postage stamp as claimed in claim 8 wherein said common carrier substrate comprises a plurality of interconnected panels that can be folded together in the form of a wallet, the surfaces upon which the said parts are adhered being covered when the wallet is in a folded condition.

10. A composite postage stamp as claimed in claim 6 wherein said substrate is flexible in nature and is provided in a rolled form.

11. A composite postage stamp comprising:

a larger definitive part and a plurality of different complementary smaller image-bearing parts, each said part having a printed front surface and a self-adhesive rear surface coating by means of which said parts are temporarily and releasably adhered to a common carrier substrate to be selectively peelable therefrom at the time of use;

said definitive part being adapted in use to be adhered to a piece of mail, and each of said image-bearing parts being adapted to be adhered to a selected area of the front surface of said definitive part, such that in use any one of said image-bearing parts can be selected to be adhered to said definitive part; and the printed front surface of said definitive part delimiting an area sized to receive any selected one of said image-bearing parts, and outside said area the printed front surface of said definitive part exhibiting postage-identifying information.

12. A composite postage stamp comprising:

a larger definitive part and a complementary smaller image-bearing part, each said part having a printed front surface and a self-adhesive rear surface coating by means of which the part is temporarily and releasably adhered to a carrier substrate to be selectively peelable therefrom at the time of use the printed front surface of said definitive part comprising a delimited area sized to receive said image-bearing part;

whereby said definitive part being adapted in use to be adhered to a piece of mail, and said image-bearing part being adapted in use to be adhered to said delimited area of the front surface of said definitive part.

13. A composite postage stamp as claimed in claim 12 wherein there are a plurality of different image-bearing parts, and wherein said definitive part and said plurality of different image-bearing parts are releasably adhered to a common carrier substrate.

* * * * *